US006561175B1

(12) United States Patent
Tidmore

(10) Patent No.: US 6,561,175 B1
(45) Date of Patent: May 13, 2003

(54) ARCHERY ARROW REST AND GUIDE

(76) Inventor: Michael O. Tidmore, 612 41st St., Tuscaloosa, AL (US) 35405

( * ) Notice: Subject to any disclaimer, the term of this patent is extended or adjusted under 35 U.S.C. 154(b) by 0 days.

(21) Appl. No.: 10/017,460

(22) Filed: Dec. 13, 2001

(51) Int. Cl.[7] ..... F41B 5/22
(52) U.S. Cl. ..... 124/44.5
(58) Field of Search ..... 124/24.1, 44.5

(56) References Cited

U.S. PATENT DOCUMENTS 5,025,773 A * 6/1991 Hintze et al. ..... 124/44.5
5,031,601 A * 7/1991 Gunter ..... 124/44.5
5,261,383 A * 11/1993 Halamay ..... 124/44.5
5,460,152 A * 10/1995 Specht ..... 124/44.5
5,462,041 A * 10/1995 Solecki ..... 124/44.5
5,529,049 A * 6/1996 Antalosky ..... 124/44.5
5,855,200 A * 1/1999 Jessee ..... 124/44.5

* cited by examiner

*Primary Examiner*—John A. Ricci

(57) ABSTRACT

A new archery arrow rest and guide having a hinged arrow support member for facilitating the positioning of the arrow within the arrow rest and guide is disclosed. The inventive device includes a pair of spaced and angled roller supports integrally formed on a base member. The base member is integrally formed on a mounting member bottom side portion. A hinged support member is hingedly attached to a mounting member top side portion and further includes a third roller support. The roller supports are positioned in such manner that rollers rotatably mounted thereto are positioned in spaced relationship to one another such that a space is formed therebetween for closely receiving an arrow shaft. The hinged support member is biased by a spring in a position such that the third roller bounds the space for closely receiving an arrow shaft.

8 Claims, 2 Drawing Sheets

ARCHERY ARROW REST AND GUIDE

BACKGROUND OF THE INVENTION

1. Field of the Invention

The present invention relates to archery devices and more particularly pertains to a new archery arrow rest and guide having a hinged arrow support member for facilitating the positioning of the arrow within the arrow rest and guide.

2. Description of the Prior Art

The use of archery devices is known in the prior art. More specifically, archery devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art archery devices include U.S. Pat. No. 5,261,383; U.S. Pat. No. 5,419,303; U.S. Pat. No. 5,031,601; U.S. Pat. No. 4,890,596; U.S. Pat. No. 5,144,937; and U.S. Pat. Des. No. 346,845.

While these devices fulfill their respective, particular objectives and requirements, the aforementioned patents do not disclose a new archery arrow rest and guide. The inventive device is attachable to a bow having a conventional arrow window and includes a mounting member having top and bottom side portions and an inside portion, the inside portion being abuttingly attachable to a side portion of the bow opposite the arrow window; a base member having a first end and a second end, the base member being integrally formed at the base member second end to the mounting member bottom side portion and extending perpendicularly therefrom; a first roller support member integrally formed at the base member first end and extending therefrom at a first acute angle relative to a base member top surface, the first roller support member having a longitudinal axis which lies in a plane perpendicular to the plane of the mounting member, the first roller support member having rotatably mounted thereto a first roller; a second roller support member integrally formed at the base member second end intermediate the first roller support member and the mounting member bottom side portion, the second roller support member extending therefrom at a second acute angle relative to the base member top surface, the second roller support member having a longitudinally axis which lies in the plane perpendicular to the plane of the mounting member and which intersects the longitudinal axis of the first roller support member, the second roller support member having rotatably mounted thereto a second roller; a hinged support member having first and second ends, the hinged support member first end being hingedly attached to the mounting member top side portion and extending perpendicularly therefrom, the hinged support member further comprising a third roller support member integrally formed at the hinged support member second end and extending perpendicularly therefrom, the third roller support member having a longitudinal axis which lies in the plane perpendicular to the plane of the mounting member and which intersects the longitudinal axes of the first and second roller support members, the third roller support member having rotatably mounted thereto a third roller; and wherein the first, second, and third rollers form therebetween a space for closely receiving an arrow shaft. The hinged support member is biased by a spring which biases the hinged support member in a position in which the third roller bounds the space for closely receiving the arrow shaft, thereby facilitating the positioning of the arrow within the arrow rest and guide.

In these respects, the archery arrow rest and guide according to the present invention substantially departs from the conventional concepts and designs of the prior art, and in so doing provides an apparatus primarily developed for the purpose of facilitating the positioning of the arrow within the arrow rest and guide.

SUMMARY OF THE INVENTION

In view of the foregoing disadvantages inherent in the known types of archery devices now present in the prior art, the present invention provides a new archery arrow rest and guide construction wherein the same can be utilized for facilitating the positioning of the arrow within the arrow rest and guide.

The general purpose of the present invention, which will be described subsequently in greater detail, is to provide a new archery arrow rest and guide apparatus and method which has many of the advantages of the archery devices mentioned heretofore and many novel features that result in a new archery arrow rest and guide which is not anticipated, rendered obvious, suggested, or even implied by any of the prior art archery devices, either alone or in any combination thereof.

To attain this, the present invention generally comprises a pair of spaced and angled roller support means integrally formed on a base member. The base member is integrally formed on a mounting member bottom side portion. A hinged support member is hingedly attached to a mounting member top side portion and further includes a third roller support means. The roller support means are positioned in such manner that rollers rotatably mounted thereto are positioned in spaced relationship to one another such that a space is formed therebetween for closely receiving an arrow shaft. The hinged support member is biased by a spring in a position such that the third roller bounds the spaced for closely receiving the arrow shaft.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new archery arrow rest and guide apparatus and method which has many of the advantages of the archery devices mentioned heretofore and many novel features that result in a new archery arrow rest and guide which is not anticipated, rendered obvious, suggested, or even implied by any of the prior art archery devices, either alone or in any combination thereof.

It is another object of the present invention to provide a new archery arrow rest and guide which may be easily and efficiently manufactured and marketed.

It is a further object of the present invention to provide a new archery arrow rest and guide which is of a durable and reliable construction.

An even further object of the present invention is to provide a new archery arrow rest and guide which is susceptible of a low cost of manufacture with regard to both materials and labor, and which accordingly is then susceptible of low prices of sale to the consuming public, thereby making such archery arrow rest and guide economically available to the buying public.

Still yet another object of the present invention is to provide a new archery arrow rest and guide which provides in the apparatuses and methods of the prior art some of the advantages thereof, while simultaneously overcoming some of the disadvantages normally associated therewith.

Still another object of the present invention is to provide a new archery arrow rest and guide having a hinged arrow support member for facilitating the positioning of the arrow within the arrow rest and guide.

Yet another object of the present invention is to provide a new archery arrow rest and guide which includes a pair of spaced and angled roller support means integrally formed on a base member. The base member is integrally formed on a mounting member bottom side portion. A hinged support member is hingedly attached to a mounting member top side portion and further includes a third roller support means. The roller support means are positioned in such manner that rollers rotatably mounted thereto are positioned in spaced relationship to one another such that a space is formed therebetween for closely receiving an arrow shaft. The hinged support member is biased by a spring in a position such that the third roller bounds the spaced for closely receiving the arrow shaft.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
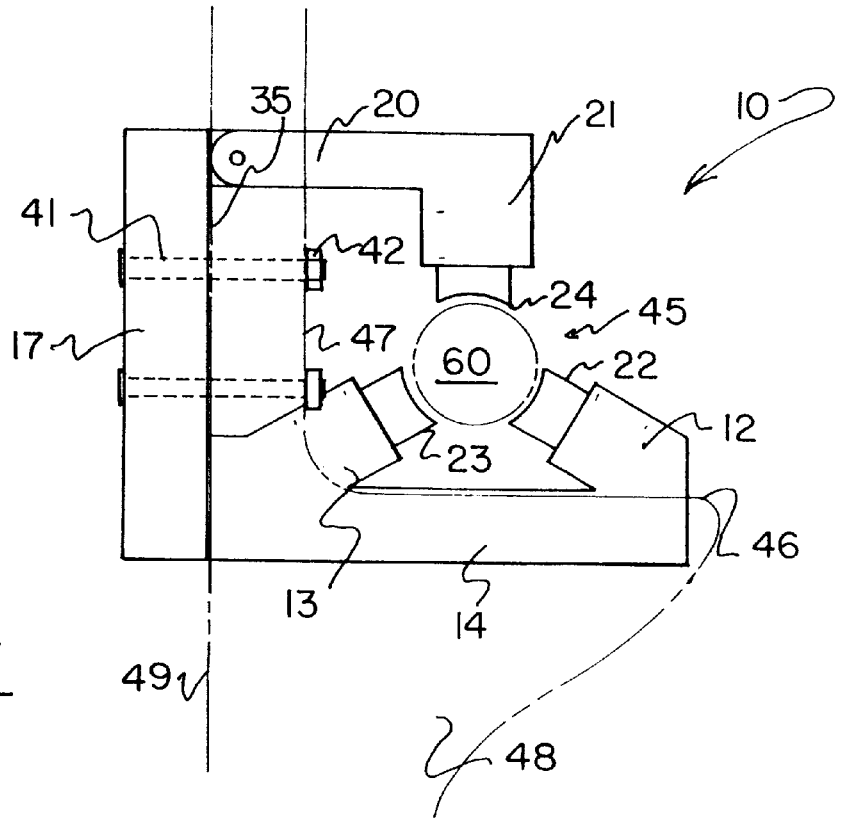
FIG. 1 is a left side elevation view of a new archery arrow rest and guide according to the present invention.

With reference now to the drawings, and in particular to FIGS. 1 through 4 thereof, a new archery arrow rest and guide embodying the principles and concepts of the present invention and generally designated by the reference numeral 10 will be described.

More specifically, it will be noted that the archery arrow rest and guide 10 comprises a mounting member 17 abuttingly attachable to a bow side portion 49, a base member 14 integrally formed to the mounting member 17 and having roller support members 12 and 13 integrally formed thereon, and a hinged support member 20 hingedly attached to the mounting member 17 and having a third roller support member 21 integrally formed thereon.

With reference to FIG. 1 there is shown a conventional bow having an arrow window 45 including an arrow shelf 46 and a vertical wall 47. As shown, the arrow rest and guide 10 is mounted in such manner that the roller support members 12, 13, and 21 are positioned to the outside of the arrow window 45, opposite the bow inner portion 48.

The mounting member 17 is shown abuttingly attached to the bow side portion 49 in such manner that the roller support members 12, 13 and 21 are positioned within the arrow window 45 above the arrow shelf 46. An arrow shaft 60 is shown closely received within a space formed between the rollers 22, 23, and 24. The space between the rollers 22, 23, and 24 provides a means for the arrow to rest in preparation for flight while the rollers 22, 23, and 24 provide a means for guiding and stabilizing the arrow.

Figure 3:
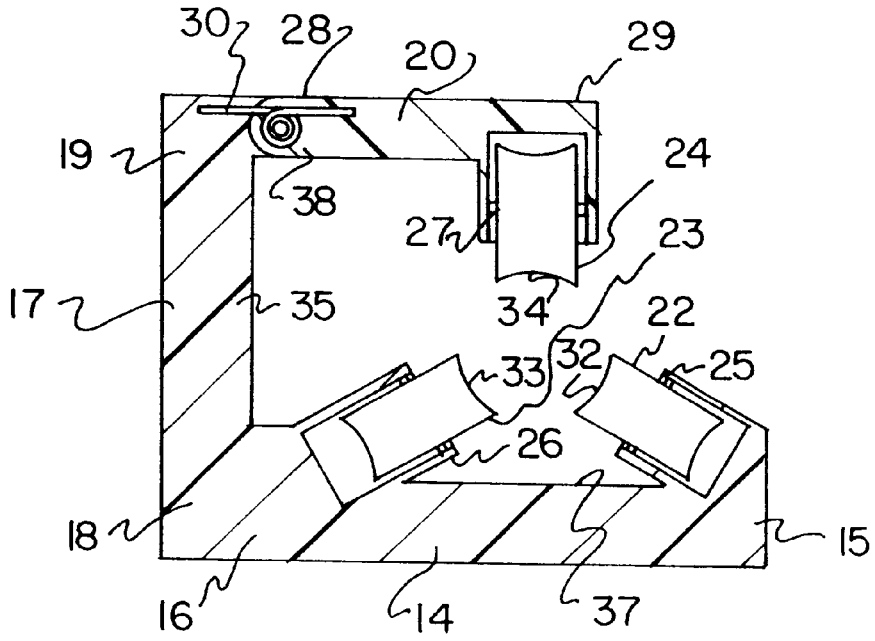
FIG. 3 is cross sectional view taken along line 3—3 of FIG. 2.

With reference to FIG. 3, the mounting member 17 is shown including a top side portion 19, a bottom side portion 18, and an inside portion 35, the inside portion 35 being designed for abutting attachment to the side portion 49 of the bow. A base member 14 having a first end 15 and a second end 16 is shown integrally formed at the base member second end 16 to the mounting member bottom side portion 18 and extending perpendicularly therefrom.

The base member further includes a first roller support member 12 integrally formed at the base member first end 15. The first roller support member 12 is shown extending from the base member first end 15 at a first acute angle relative to a base member top surface 37. The first roller support member 12 has a longitudinal axis which lies in a plane perpendicular to the plane of the mounting member. Also shown rotatably mounted to the first roller support member 12 is a first roller 22, the first roller preferably being formed of rubber or being coated with Teflon or a similar material for reducing noise as the arrow travels upon the first roller 22.

With continued reference to FIG. 3, a second roller support member 13 is shown integrally formed at the base member second end 16 intermediate the first roller support member 12 and the mounting member bottom side portion 18. The second roller support member 13 is shown extending from the base member second end 16 at a second acute angle relative to the base member top surface 37. The second roller support member 13 further has a longitudinal axis which lies in the plane perpendicular to the plane of the mounting member 17, the second roller support member 13 longitudinal axis intersection the first roller support member 12 longitudinal axis. A second roller 23 formed of a similar material as the first roller 22 is shown rotatably mounted to the second roller support member 13.

A hinged support member 20 is shown having a first end 28 and a second end 29. The hinged support member first end 28 is shown hingedly attached to the mounting member top side portion 19. The hinged support member 20 is shown biased by a spring 30 in a first position perpendicular to the mounting member top side portion 19. A third roller support member 21 is shown integrally formed at the hinged support member second end 29 and extending perpendicularly therefrom. The third roller support member 20 has a longitudinal axis which lies in the plane perpendicular to the plane of the mounting member 17 and which further intersects the longitudinal axes of the first and second roller support members 12 and 13 when the hinged support member 20 is in the first position. A third roller 24 formed of a similar as the first roller 22 is shown rotatably mounted to the third roller support member 21.

Figure 2:
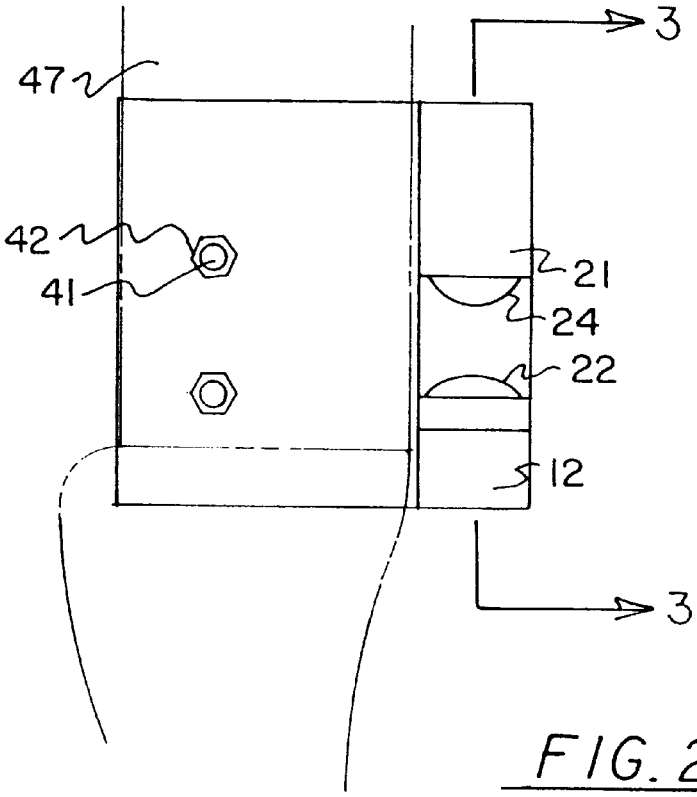
FIG. 2 is a front side elevation view thereof.

As shown in FIGS. 1, 2, and 3 a space is formed between the first, second and third rollers 22, 23, and 24 for closely receiving the arrow shaft 60. In the preferred embodiment, the first acute angle is 30 degrees and the second acute angle is 30 degrees and the longitudinal axes of the first, second and third roller support members 12, 13, and 21 intersect at a point when the hinged support member 20 is in the first position.

In the preferred embodiment, the first roller 22 is rotatably mounted to the first roller support member 12 by means of a first pin 25 which is shown extending through a first roller 22 axis of rotation and secured by conventional means to the first roller support member 12. The first roller 22 axis of rotation is disposed perpendicularly to the first roller support member 12 longitudinal axis and in the plane perpendicular to the plane of the mounting member 17. In similar fashion the second roller 23 is rotatably mounted to the second roller support member 13 by means of a second pin 26 which extends through a second roller 23 axis of rotation and secured by conventional means to the second roller support member 13. The second roller 23 axis of rotation is disposed perpendicularly to the second roller support member 13 longitudinal axis and in the plane perpendicular to the plane of the mounting member 17. The third roller 24 is rotatably mounted to the third roller support member 21 by means of a third pin 27 which extends through a third roller 24 axis of rotation and secured by conventional means to the third roller support member 21. The third roller 24 axis of rotation is disposed perpendicularly to the third roller support member 21 longitudinal axis and in the plane perpendicular to the plane of the mounting member 17.

As shown in FIGS. 1 and 2, the first roller 22 preferably includes a first roller concave outer surface 32, the second roller 23 preferably includes a second roller concave outer surface 33 and the third roller 24 preferably includes a third roller concave outer surface 34. The concave surface 32, 33, and 34 further facilitate the positioning and guiding of the arrow upon flight.

With reference to FIG. 3, the hinged support member 20 is shown hingedly attached to the mounting member top side portion 19 by means of the spring 30. The spring 30 is fixedly attached to the mounting member top side portion 19 at one end thereof and to the hinged support member second end 28 at the other end thereof. In the first position, the spring 30 biases the hinged support member 20 in such manner that the third roller 24 bounds the space for closely receiving the arrow shaft 60.

Figure 4:
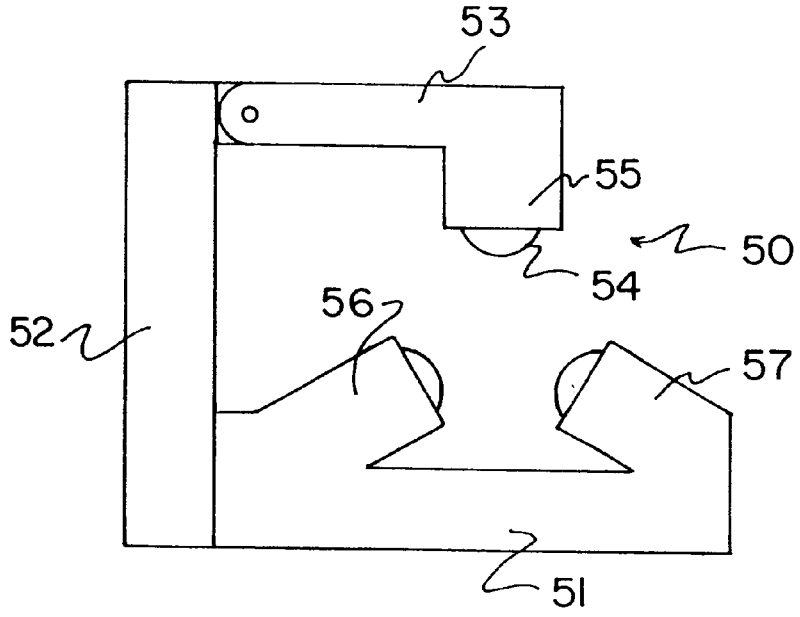
FIG. 4 is a side elevation view of an alternative embodiment of the present invention.

With reference to FIG. 4 an alternative embodiment 50 of the present invention is shown including a base portion 51 integrally formed to a lateral portion 52 and extending perpendicularly therefrom. The base portion 51 includes support members 56 and 57. A hinged support member 53 is shown hingedly attached to the lateral portion 52 and includes a bearing support member 55. In this embodiment conventional bearing type rollers 54 are mounted in the support member 55, 56, and 57 by means of bearings.

In use, the archery arrow rest and guide 10 is attached to the arrow window 45 by means of fasteners such as bolt 41 and nut 42 (FIG. 2). By retracting the hinged support member 20 from the first position an arrow is easily positioned upon the first and second rollers 22 and 23. The hinged support member 20 is then returned to the first position to retain the arrow within the space for closely receiving the arrow shaft 60.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An archery arrow rest and guide for use with an archery bow having an arrow window comprising:

a mounting member having top and bottom side portions and an inside portion, the inside portion being abuttingly attachable to a side portion of the bow opposite the arrow window;

a base member having a first end and a second end, the base member being integrally formed at the base member second end to the mounting member bottom side portion and extending perpendicularly therefrom;

a first roller support member integrally formed at the base member first end and extending therefrom at a first acute angle relative to a base member top surface, the first roller support member having a longitudinal axis which lies in a plane perpendicular to the plane of the mounting member, the first roller support member having rotatably mounted thereto a first roller;

a second roller support member integrally formed at the base member second end intermediate the first roller support member and the mounting member bottom side portion, the second roller support member extending therefrom at a second acute angle relative to the base member top surface, the second roller support member having a longitudinal axis which lies in the plane perpendicular to the plane of the mounting member and which intersects the longitudinal axis of the first roller support member, the second roller support member having rotatably mounted thereto a second roller;

a hinged support member having first and second ends, the hinged support member first end being hingedly attached to the mounting member top side portion and extending perpendicularly therefrom, the hinged support member further comprising a third roller support member integrally formed at the hinged support member second end and extending perpendicularly therefrom, the third roller support member having a longitudinal axis which lies in the plane perpendicular to the plane of the mounting member and which intersects the longitudinal axes of the first and second roller support members 12 and 13 when the hinged support member is in a first position perpendicular to the mounting member 17, the third roller support member having rotatably mounted thereto a third roller; and wherein the first, second the third rollers form therebetween a space for closely receiving an arrow shaft when the hinged support member is in the first position.

2. The archery arrow rest and guide of claim 1, wherein the first roller is rotatably mounted to the first roller support member by means of a first pin which extends through a first roller axis of rotation, the first roller axis of rotation being disposed perpendicularly to the first roller support member longitudinal axis, and wherein the second roller is rotatably mounted to the second roller support member by means of a second pin which extends through a second roller axis of rotation, the second roller axis of rotation being disposed perpendicularly to the second roller support member longitudinal axis, and wherein the third roller is rotatably mounted to the third roller support member by means of a third pin which extends through a third roller axis of rotation, the third roller axis of rotation being disposed parallel to a longitudinal axis of the hinged support member.

3. The archery arrow rest and guide of claim 1, wherein the first roller further comprises a first roller concave outer surface, the second roller further comprises a second roller concave outer surface and the third roller further comprises a third roller concave outer surface.

4. The archery arrow rest and guide of claim 1, wherein the hinged support member is hingedly attached to the mounting member top side portion by means of a spring fixedly attached to the mounting member top side portion at one end thereof at to the hinged support member second end at the other end thereof, the spring being for biasing the hinged support member in the first position wherein the third roller bounds the space for closely receiving the arrow shaft.

5. The archery arrow rest and guide of claim 1, wherein the first, second and third rollers are rotatably mounted in the first, second and third roller support members by means of bearings.

6. The archery arrow rest and guide of claim 1, wherein the mounting member is abuttingly attachable to a side portion of the bow opposite the arrow window by means of removable fasteners.

7. The archery arrow rest and guide of claim 1, wherein the first acute angle is 30 degrees and wherein the second acute angle is 30 degrees.

8. The archery arrow rest and guide of claim 1, wherein the longitudinal axes of the first, second and third roller support members intersect at a point.

* * * * *